US007196296B2

(12) United States Patent
Yamamoto

(10) Patent No.: US 7,196,296 B2
(45) Date of Patent: Mar. 27, 2007

(54) IMAGE FORMING APPARATUS AND FIXING APPARATUS

(75) Inventor: Naoyuki Yamamoto, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

(21) Appl. No.: 11/183,886

(22) Filed: Jul. 19, 2005

(65) Prior Publication Data

US 2005/0252912 A1 Nov. 17, 2005

Related U.S. Application Data

(62) Division of application No. 10/664,934, filed on Sep. 22, 2003, now Pat. No. 6,970,664.

(30) Foreign Application Priority Data

Sep. 25, 2002 (JP) ..... 2002-279074
Aug. 26, 2003 (JP) ..... 2003-208786

(51) Int. Cl.
*H05B 6/14* (2006.01)
*G03G 15/20* (2006.01)

(52) U.S. Cl. ..... 219/619; 399/330

(58) Field of Classification Search ..... 219/619, 219/618, 600, 469, 216; 399/67, 69, 49, 399/320, 329, 328, 330
See application file for complete search history.

(56) References Cited

U.S. PATENT DOCUMENTS 5,428,434 A 6/1995 Hirao ..... 399/69
5,768,655 A 6/1998 Yoshino et al. ..... 399/69
5,768,673 A 6/1998 Morigami ..... 399/330
5,794,096 A * 8/1998 Okabayashi ..... 399/33
5,907,348 A * 5/1999 Ogasawara et al. ..... 347/212
6,219,522 B1 4/2001 Ishizuka et al. ..... 399/333
6,240,263 B1 5/2001 Watanabe et al. ..... 399/69

(Continued)

FOREIGN PATENT DOCUMENTS

JP 51-109736 9/1976

(Continued)

*Primary Examiner*—Daniel Robinson
(74) *Attorney, Agent, or Firm*—Fitzpatrick, Cella, Harper & Scinto

(57) ABSTRACT

An image forming apparatus capable of realizing low power consumption of a fixing means is provided. The image forming apparatus includes an image forming means for forming an unfixed image t on a recording material P, and a fixing means 10 for heat-fixing the unfixed image. In the image forming apparatus, the fixing means 10 is of electromagnetic induction heating type wherein the fixing means 10 includes a magnetic flux generation means 36 and an induction heating member 10*a* for generating heat through electromagnetic induction by the action of generated magnetic flux of the magnetic flux generation means, and the unfixed image is heat-fixed on the recording material by generated heat of the induction heating member 10*a*. The image forming apparatus is characterized by further including a detection means for detecting density information of an image to be formed by the image forming means and a control means for variably changing a heat generating rate of the fixing apparatus depending on the image density information detected by the detection means.

5 Claims, 8 Drawing Sheets

U.S. PATENT DOCUMENTS

| | | | | |
|---|---|---|---|---|
| 6,408,146 | B1 * | 6/2002 | Nagano | 399/67 |
| 6,438,335 | B1 | 8/2002 | Kinouchi et al. | 399/67 |
| 6,456,818 | B1 * | 9/2002 | Nakayama et al. | 399/328 |
| 6,483,088 | B2 * | 11/2002 | Uehara et al. | 219/619 |
| 6,505,027 | B2 * | 1/2003 | Takeuchi et al. | 399/328 |
| 6,545,255 | B2 * | 4/2003 | Sato et al. | 219/619 |
| 6,643,476 | B1 | 11/2003 | Kinouchi et al. | 399/69 |
| 2002/0023920 | A1 | 2/2002 | Abe et al. | 219/619 |

FOREIGN PATENT DOCUMENTS

| | | |
|---|---|---|
| JP | 58-178385 | 10/1983 |
| JP | 59-88770 | 5/1984 |
| JP | 61-26071 | 2/1986 |
| JP | 2-213888 | 8/1990 |
| JP | 7-287471 | 10/1995 |
| JP | 8-152807 | 6/1996 |
| JP | 9-127810 | 5/1997 |

* cited by examiner

IMAGE FORMING APPARATUS AND FIXING APPARATUS

This is a divisional application of U.S. patent application Ser. No. 10/664.934, filed on Sep. 22, 2003, now U.S. Pat. No. 6,970,664.

FIELD OF THE INVENTION AND RELATED ART

The present invention relates to a fixing apparatus for heat-fixing an unfixed image on a recording material and an image forming apparatus, such as an electrophotographic apparatus, including an image forming means for forming the unfixed image through an appropriate image forming principle or process of a transfer type or a direct type, and including a fixing means for heat-fixing the unfixed image.

For example, in an image forming apparatus of a transfer-type electrophotographic process, an unfixed toner image which has been formed and carried on a surface of electrophotographic photosensitive member as an image bearing member is transferred onto a transfer material as a recording material, and the unfixed toner image transferred onto the transfer material is heat-fixed thereon as a permanently fixed image by a fixing means, followed by output of the transfer material as an image-formed product. The toner is a visualizing powder, possessing melt fixability, comprising a resin, a magnetic material, a colorant, etc.

As the fixing means, an fixing apparatus of a heat roller type has been conventionally used dominantly. This fixing apparatus includes a pair of rotational rollers consisting of a fixation roller (heat roller), which contains therein a heat source such as a halogen lamp and is heated and temperature-controlled, and a pressure roller. A recording material, as a member to be heated, on which an unfixed toner image is formed and carried is guided into a pressing nip portion (fixation nip portion) between the pair o fixation and pressure rollers, and then is sandwiched and carried at the nip portion to heat-fix the unfixed toner image onto the recording material surface under application of heat and pressure.

Further, such a fixing apparatus of the type wherein a fixation roller is heated by electromagnetic induction has also been proposed. In this fixing apparatus, an eddy current is generated in an electroconductive layer (induction heating layer) provided to an inner surface of the fixation roller by magnetic flux generated by an exciting coil as a magnetic flux generation means to heat the electro-conductive layer by Joule heat. As a result, the fixation roller is heated and temperature-controlled at a predetermined fixation temperature (e.g., as described in Japanese Laid-Open Patent Application (JP-A) Hei 7-287471, JP-A Sho 58-178385, JP-A Hei 9-127810, and Japanese Laid-Open Utility Model Application Sho 51-109736).

Such an electromagnetic induction heating-type fixing apparatus can place its heat generating source (induction heating member) in the immediate vicinity of toner, so that it possesses such a characteristic feature that a time required for increasing the temperature of the fixation roller surface to an appropriate temperature at the time of actuating the fixing apparatus can be shortened when compared with the conventional heat roller-type fixing apparatus using a halogen lamp. Further, the electromagnetic induction heating-type fixing apparatus is also characterized in that a heat transfer path from the heat generation source to the toner is short and simple, so that a resultant thermal efficiency becomes high, and that it is also possible to arbitrarily control the heat generating rate by changing an electric power supplied to and a frequency applied to an exciting coil.

Generally, the fixing apparatus is kept at a predetermined temperature by measuring the surface temperature of a fixation roller, comparing the resultant measured value with a predetermined value to effect ON-OFF control of energization to a heating source for heating the fixation roller.

However when fixation of a mono-color image and that of full-color image are compared, the same quantity (amount) of heat is given in both the fixations by the above-mentioned temperature control method even though the two fixations of mono-color and full-color images are different in quality of heat required for fixation.

SUMMARY OF THE INVENTION

An object of the present invention is to provide an fixing apparatus capable of reducing power consumption of fixing means.

Another object of the present invention is to provide an image forming apparatus using the fixing apparatus.

According to the present invention, there are provided:

(1) a fixing apparatus, comprising:
- magnetic flux generation means for generating a magnetic flux by energization,
- an induction heating member for generating heat by the magnetic flux generated by said magnetic flux generating means to heat an unfixed image on a recording material by the generated heat,
- temperature detection means for detecting a temperature of said induction heating member,
- temperature control means for controlling the temperature of said induction heating member to a predetermined target temperature on the basis of information of said temperature detection means,
- heat generating rate change means for changing a heat generating rate per unit time of said induction heating means, and
- density detection means for detecting information as to a density of an image to be formed on the recording material,
- wherein said heat generating rate change means changes the heat generating rate on the basis of the information of said density detection means;

(2) the fixing apparatus of (1), wherein said heat generating rate change means changes the heat generating rate on the basis of the information of said density detection means without changing the predetermined target temperature;

(3) an apparatus of (1) or (2), wherein said magnetic flux generation means has an exciting coil, and said heat generating rate change means changes the heat generating rate by changing a frequency of a high-frequency current to be applied to the exciting coil;

(4) an apparatus of (1) or (2), wherein said heat generating rate change means changes an electric power for energizing said magnetic flux generation means;

(5) an apparatus of (1) or (2), wherein said magnetic flux generation means has an exciting coil, and said heat generating rate change means changes a current to be applied to the exciting coil of said magnetic flux generation means;

(6) an apparatus of (1) or (2), wherein said magnetic flux generation means has an exciting coil, and said heat generating rate change means changes a voltage to be applied to the exciting coil of said magnetic flux generation means;

(7) an image forming apparatus, comprising:
image forming means for forming an unfixed image on a recording material,
magnetic flux generation means for generating a magnetic flux by energization,
an induction heating member for generating heat by the magnetic flux generated by said magnetic flux generating means to heat the unfixed image on the recording material by the generated heat,
temperature detection means for detecting a temperature of said induction heating member,
temperature control means for controlling the temperature of said induction heating member to a predetermined target temperature on the basis of information of said temperature detection means,
heat generating rate change means for changing a heat generating rate of said induction heating means, and
density detection means for detecting information as to a density of an image to be formed on the recording material,
wherein said heat generating rate change means changes the heat generating rate on the basis of the information of said density detection means;

(8) an apparatus of (1), wherein said heat generating rate change means changes the heat generating rate on the basis of the information of said density detection means without changing the predetermined target temperature;

(9) an apparatus of (7) or (8), wherein said magnetic flux generation means has an exciting coil, and said heat generating rate change means changes the heat generating rate by changing a frequency of a high-frequency current to be applied to the exciting coil;

(10) an apparatus of (7) or (8), wherein said heat generating rate change means changes an electric power for energizing said magnetic flux generation means;

(11) an apparatus of (7) or (8), wherein said magnetic flux generation means has an exciting coil, and said heat generating rate change means changes a current to be applied to the exciting coil of said magnetic flux generation means;

(12) an apparatus of (7) or (8), wherein said magnetic flux generation means has an exciting coil, and said heat generating rate change means changes a voltage to be applied to the exciting coil of said magnetic flux generation means;

(13) a fixing apparatus, comprising:
a heating member for heating an unfixed image on a recording material,
heating means for generating heat by energization to heat said heating member,
temperature detection means for detecting a temperature of said heating member,
temperature control means for controlling the temperature of said heating member to a predetermined target temperature on the basis of information of said temperature detection means,
electric power change means for changing an electric power of said heating means, and
density detection means for detecting information as to a density of an image to be formed on the recording material,
wherein said heat generating rate change means changes the heat generating rate on the basis of the information of said density detection means without changing the predetermined target temperature;

(14) an apparatus of (13), wherein said electric power change means changes a current applied to said heating means;

(15) an apparatus of (13), wherein aid electric power change means changes a voltage applied to said heating means;

(16) an image forming apparatus, comprising:
image forming means for forming an unfixed image on a recording material,
a heating member for heating the unfixed image on the recording material,
heating means for generating heat by energization to heat said heating member,
temperature detection means for detecting a temperature of said heating member,
temperature control means for controlling the temperature of said heating member to a predetermined target temperature on the basis of information of said temperature detection means,
electric power change means for changing an electric power of said heating means, and
density detection means for detecting information as to a density of an image to be formed on the recording material,
wherein said heat generating rate change means changes the heat generating rate on the basis of the information of said density detection means without changing the predetermined target temperature;

(17) an apparatus of (16), wherein said electric power change means changes a current applied to said heating means;

(18) an apparatus of (16), wherein aid electric power change means changes a voltage applied to said heating means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

DETAILED DESCRIPTION OF THE PREFERRED EMBODIMENTS (1) Image Forming Apparatus FIG. 1 illustrates a schematic sectional structure of a digital-type four color-based full-color image forming apparatus as an embodiment of the image forming apparatus according to the present invention.

Figure 1:
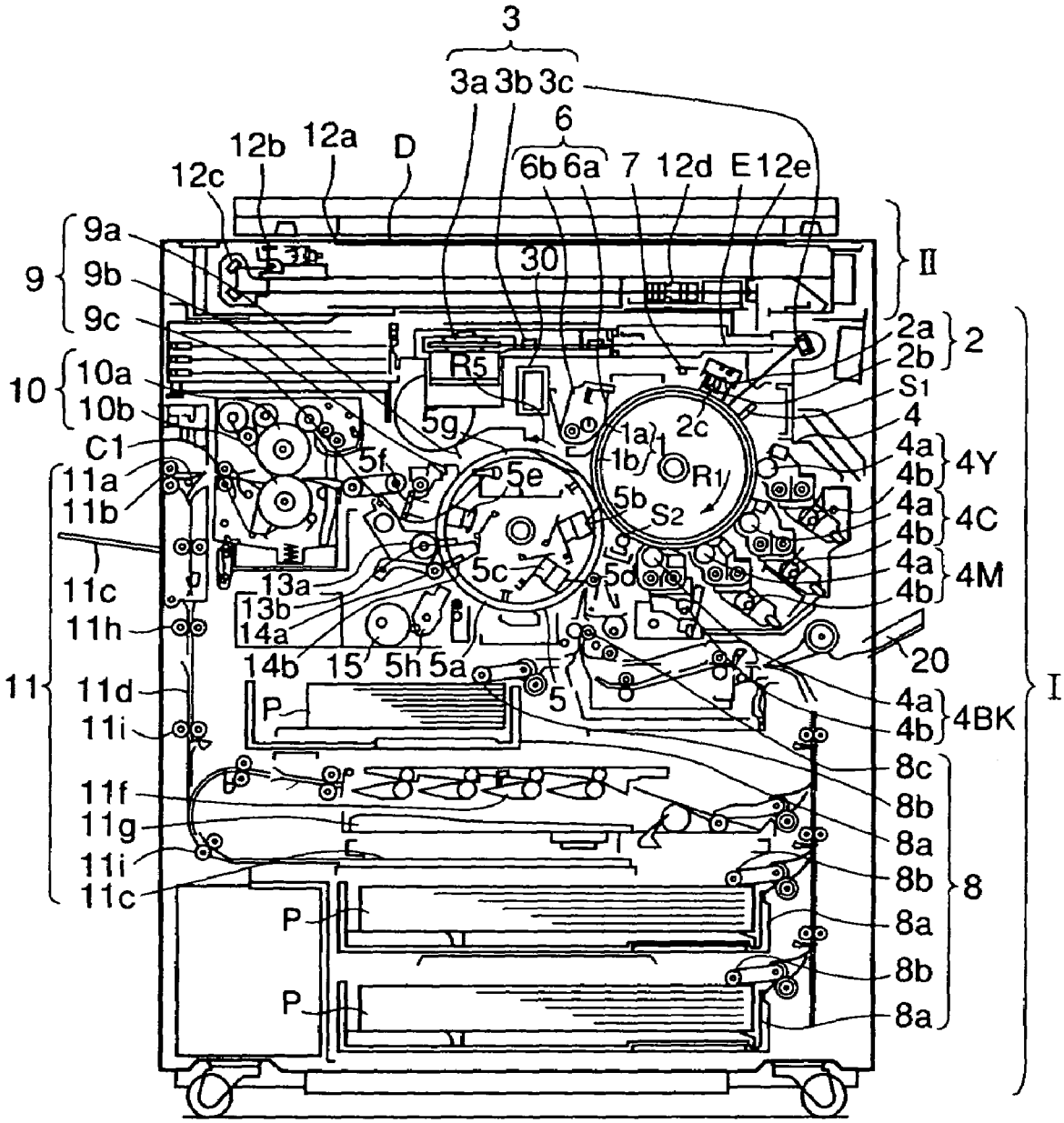
FIG. 1 is a sectional view showing a schematic structure of an embodiment of the image forming apparatus according to the present invention.

The image forming apparatus of this embodiment includes a lower digital color image printer section (hereinafter, referred simply to as "printer section") I and an upper digital color image reader section ("reader section") II, and, e.g., forms an image on a recording material P on the basis of image information of an original D read by the reader section II.

a) Structure of Printer Section I

The printer section I includes a photosensitive drum 1, as an image bearing member, which is rotationally driven in a direction o an arrow R1. Around the photosensitive drum 1, a primary charger (charging means) 2, an exposure means 3, a developing apparatus (developing means) 4, a transfer apparatus 5, a cleaning device 6, and a pre-exposure lamp 7 are disposed in this order along its rotation direction.

Below the transfer apparatus 5, i.e., at the lower-half portion of the printer section I, a paper supply and conveyance unit 8 is disposed. Above the transfer apparatus 5, a separation means 9 is disposed, and on a downstream side from the separation means 9 (on a downstream side with respect to a carrying direction of the recording material P, a fixation device 10 as a fixation means (fixing apparatus) and a paper output unit 11 are disposed.

The photosensitive drum 1 includes a drum-shaped support 1*a* made of aluminum and a photosensitive member 1*b*, of OPC (organic photoconductor), which covers a circumferential surface of the support 1*a*, and is structured to be rotationally driven by drive means (not shown) at a predetermined process speed (peripheral speed) in the arrow R1 direction.

The primary charger 2 is a corona charger including a shield 2*a* having an opening opposite from the photosensitive drum 1, a discharge wire 2*b* arranged at an internal side of the shield 2*a* and in parallel with a generating line of the photosensitive drum 1, and a grid 2*c* disposed at the opening and regulating a charge potential. The primary charger 2 is supplied with a charging bias voltage by a power supply (not shown), whereby the surface of the photosensitive drum 1 is uniformly charged to a predetermined polarity and a predetermined potential.

The exposure means 3 includes a laser output portion (not shown) emitting a laser light E on the basis of an image signal from the reader section I described later, and a polygon mirror 3*a*, a lens 3*b*, and a mirror 3*c* for reflecting and sweeping the laser light E. The exposure means 3 is structured so that the surface of the photosensitive drum 1 is subjected to scanning exposure with the laser light E so as to remove electric charges at the exposed portion to form an electrostatic latent image.

In this embodiment, the electrostatic latent image formed on the surface of the photosensitive drum 1 is color-separated into four colors of yellow, cyan, magenta and black, based on the original image, and corresponding color electrostatic latent images are successively formed.

The developing apparatus 4 includes four developing devices, i.e., developing devices 4Y, 4C, 4M and 4BK containing therein resin-based color toners (developers) of yellow, magenta, cyan and black, respectively. The respective developing devices 4Y, 4C, 4M and 4BK includes developing sleeves 4*a* for attaching the corresponding color toners onto the electrostatic latent images formed on the surface of the photosensitive drum 1. The developing device for a predetermined color subjected to development of the electrostatic latent image is selectively disposed in a developing position closer to the photosensitive drum 1 surface and causes the toner to attach onto the electrostatic latent image through the developing sleeve 4*a*, thereby to form a toner image (visible image) as a visualized image. Incidentally, the three color developing devices other than the developing device subjected to development are arranged to be kept away from the developing position.

The transfer apparatus 5 includes a transfer drum (recording material carrying member) for carrying the recording material P at its surface, a transfer charger 5*b* for transferring the toner image onto the photosensitive drum 1, an adsorption charger 5*c* for causing the recording material P onto the transfer drum 5*a*, an adsorption roller 5*d* disposed opposite from the adsorption charger 5*c*, an internal charger 5*e*, and an external charger 5*f*. At a peripheral opening area of the transfer drum 5*a* which is supported by bearings so as to be rotationally driven in a direction of an arrow R5, a recording material carrying sheet 5*g* of a dielectric material is integrally disposed under tension in a cylindrical shape. The recording material carrying sheet 5*g* is comprised of a dielectric sheet, such as a polycarbonate sheet. The transfer apparatus 5 is structured to adsorb and carry the recording material P at the surface of the transfer drum 5*a*.

The cleaning device 6 includes a cleaning blade 6*a* for scraping a residual toner which has not been transferred onto the recording material P and still remains on the surface of the photosensitive drum 1, and a cleaning container 6*b* for recovering the scraped toner.

The pre-exposure lamp 7 is disposed adjacent to the primary charger 2 on its upstream side and removes unnecessary electric charges from the surface of the photosensitive drum 1 which has been cleaned by the cleaning device 6.

The paper supply and conveyance unit 8 includes a plurality of paper supply cassettes 8*a* for stacking and accommodating recording materials P different in size, paper supply rollers 8*b* for feeding the recording materials P from the paper supply cassettes 8*a*, a multitude of conveyance rollers, and a registration roller 8*e*. The paper supply and conveyance unit 8 feeds the recording material 8 in a predetermined size to the transfer drum 5*a*.

The separation means 9 includes, e.g., a separation charger 9*a*, a separation claw 9*b*, and a separation forcing roller 9*c* for separating the recording material P, after being subjected to toner image transfer, from the transfer drum 5*a*.

The fixation device 10 is a fixing apparatus of an electromagnetic induction heating-type and includes a fixation roller 10*a* to be heated by electromagnetic induction, and a pressure roller 10*b* which is disposed below the fixation roller 10*a* and pressing the recording material P against the fixation roller 10*a*. The fixation device 10 will be described later in detail.

The paper output unit 11 includes a conveyance path switching guide 11*a*, a discharge roller 11*b*, a paper output tray 11*c*, etc., disposed downstream from the fixation device 10. Below the conveyance path switching guide 11*a*, in order to effect double-sided image formation to one recording material P, a conveyance vertical path 11*d*, an inversion path 11*e*, a stacking member 11*f*, an intermediary tray 11*g*, conveyance rollers 11*h* and 11*i*, an inversion roller 11*j*, etc., are disposed.

Further, between the primary charger 2 and the developing apparatus 4 at a peripheral surface of the photosensitive drum 1, a potential sensor S1 for detecting a charged potential of the photosensitive drum surface is disposed. Between the developing apparatus 4 and the transfer drum 5*a*, a density sensor 82 for detecting a density of the toner image on the photosensitive drum 1 is disposed.

b) Structure of Reader Section II

The reader unit II disposed above the printer section I includes, e.g., an original glass plate 12*a* on which an original D is placed, an exposure lamp 12*b* for exposing and scanning the image surface of the original D While being moved, a plurality of mirrors 12*c* for reflecting the reflected light from the original D, a lens 12*d* for concentrating the reflected light, and a full-color sensor (an image pickup device) for forming a color separation image signal on the basis of light from the lens 12*d*.

The color separation image signal is sent through an amplifier circuit (not shown), processed by a video processing unit (not shown) and is outputted to the above-described printer unit I.

c) Image Forming Operation

In the following description, a four color-based full-color image is formed through formation of color toner images of yellow, cyan, magenta and black.

The image of the original D placed on the original glass plate 12*a* in the reader section II is irradiated with light from the exposure lamp 12*b*, and color separation is performed. Then, a yellow image is first read by the full-color sensor 12*e*, subjected to a predetermined processing, and is sent to the printer section I as an image signal.

In the printer section I, the photosensitive drum 1 is rotationally driven in the arrow R1 direction and the surface of the photosensitive drum 1 is uniformly charged by the primary charger 2.

On the basis of the image signal sent from the reader section II described above, the laser light E is outputted from a laser output portion of the exposure means 3, and the surface of the photosensitive drum 1 which has already been electrically charged is subjected to scanning exposure with the laser light E through the polygon mirror etc., whereby electric charges at the resultant exposed portion of the photosensitive drum 1 surface are removed to form an electrostatic latent image for yellow.

In the developing apparatus 4, the yellow developing device 4Y is located at a prescribed developing position, and other developing devices 4C, 4M and 4BK are kept away from the developing position. On the other electrostatic latent image formed on the photosensitive drum 1 surface, a yellow toner is attached, thus visualizing the electrostatic latent image into a toner image.

The resultant yellow toner image on the photosensitive drum 1 is transferred onto the recording material P carried on the transfer drum 5*a*.

The recording material P having a size suitable for the original image is fed from the predetermined paper supply cassette 8*a* to the transfer drum 5*a* at a predetermined timing via the paper supply roller 8*b*, the conveyance rollers, the registration roller 8*c*, etc.

The thus fed recording material P is rotated in the arrow R5 direction while being adsorbed on the transfer drum 5*a* so as to be wound about the transfer drum 5*a*, and the yellow toner image on the photosensitive drum I surface is transferred onto the recording material P.

On the other hand, the residual toner remaining on the surface of the photosensitive drum 1 after the toner image transfer is removed by the cleaning device 6. Further, by the pre-exposure lamp 7, unnecessary electric charges are removed, and the photosensitive drum 1 is subjected to a subsequent image formation which starts with the primary charger 2. The above-mentioned respective processes from the reading of the original image by the reader section I to the charge removal via the transfer of the toner image onto the recording material P by the transfer drum 5*a* and the cleaning of the photosensitive drum 1, are similarly performed with respect to other colors, i.e., cyan, magenta and black. As a result, onto the recording material P carried on the transfer drum 5*a*, a four-color toner images are transferred in a superposition manner.

The recording material P subjected to the transfer o the four-color toner images is separated from the transfer drum 5*a* by the separation charger 9*a*, the separation claw 9*b*, etc., and is sent to the fixation device 10 in such a state that the unfixed toner image is beard on the surface of the recording material P.

The recording material P is heated and pressed at the abutting nip portion (fixation nip portion) between the fixation roller 10*a* and the pressure roller 10*b*, whereby the toner image on its surface is melt-fixed to complete fixation.

The recording material P after the fixation is discharged on the paper output tray 11*c* by the discharge roller 11*b*.

Incidentally, in the case of forming the image on both sides of the recording material P, the fixation device 10 once guides the discharged recording material P to the inversion path 11*e* through the conveyance vertical path 11*d* by immediately driving the conveyance path switching guide 11*a*. Thereafter, the recording material P is sent from the inversion path 11*e* in a direction opposite from the conveyance direction by inversion of the inversion roller 11*j* while changing a trailing edge of the recording material P to its leading edge, followed by accommodation into the intermediary tray 11*g*. Thereafter, an image is formed on the other surface of the recording material P by performing again the above-described image forming process, and the resultant recording material P is discharged on the paper output tray 11*c*.

On the transfer drum 5*a* after separating the recording material P therefrom, in order to prevent scattering and attachment of toner powder (particle) onto the photosensitive member carrying sheet 5*g* and attachment of oil onto the recording material P, a cleaning operation is performed by a fur brush 14*a* and a backup brush 13*b* disposed opposite from each other via the recording material carrying sheet 5*g* and by an oil removal roller 14*a* and a backup brush 14*b* disposed opposite from each other via the recording material carrying sheet 5*g*. The cleaning operation is performed before or after the image formation or at any time of occurrence of paper jam.

(2) Fixation Device 10

Figure 2:
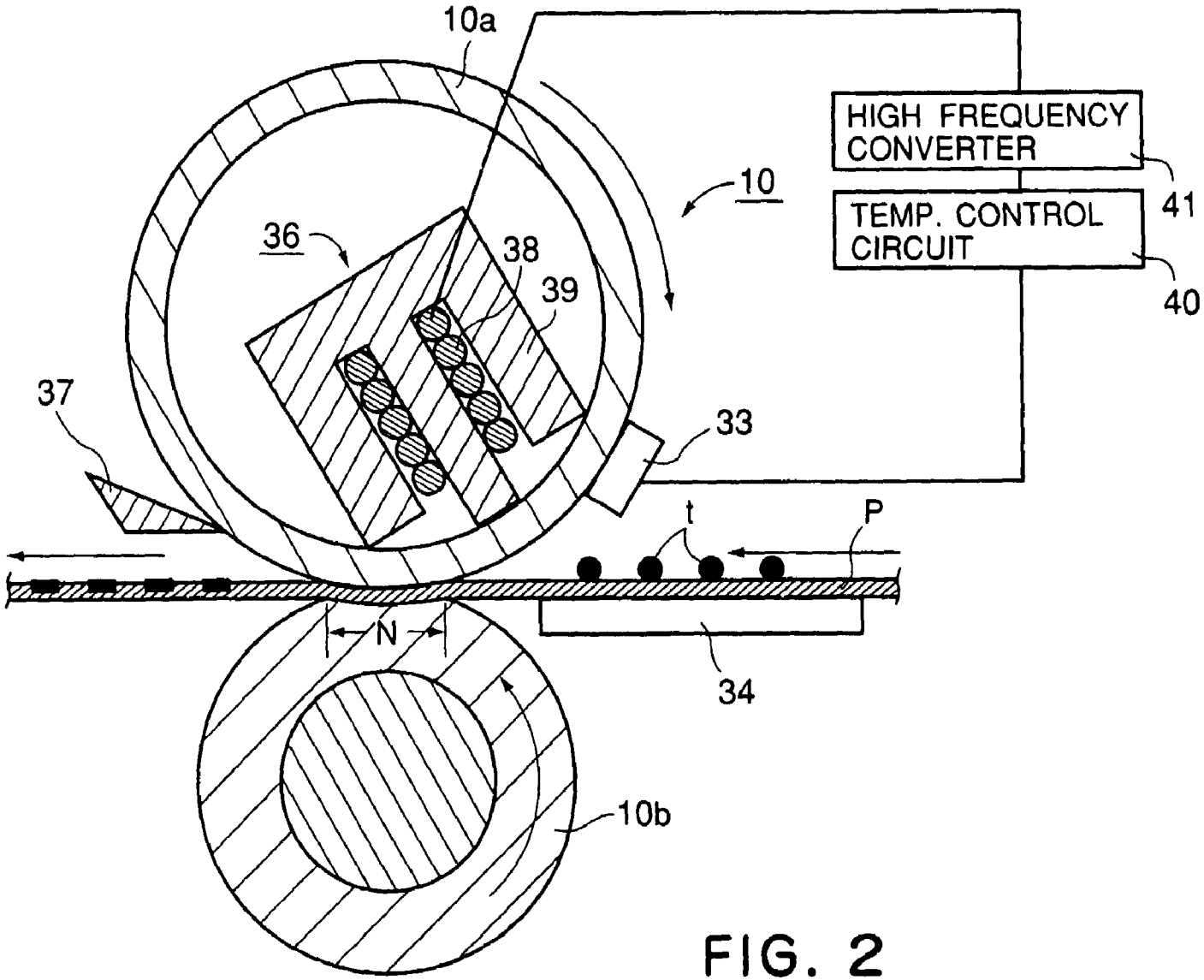
FIG. 2 is a schematic cross-sectional view of a fixation device (apparatus).

FIG. 2 is a schematic cross-sectional view of the fixation device 10 as the fixation means (fixing apparatus).

This fixation device 10 is of electromagnetic induction heating type and includes the fixation roller 10*a* to be subjected to electromagnetic induction heating and the pressure roller 10*b* which is disposed below the fixation roller 10*a* and presses the recording material P against the fixation roller 10*a*. Within the fixation roller 10*a*, an exciting coil 38 and a magnetic core 39 as magnetic flux generation means are disposed.

The fixation roller 10*a* may, e.g., be prepared by disposing a 10–50 μm-thick layer of PTFE or PFA on an iron core cylinder (induction heating means or member) (outer diameter: 40 mm; thickness: 0.7 mm), in order to improve surface releasability.

As another material (induction heating member) for the fixation roller 10*a*, it is also possible to use, e.g., a magnetic material (magnetic metal), such as magnetic stainless steel, having a relatively high permeability p and an appropriate resistivity ρ. Further, even if the material is a non-magnetic material, an electroconductive material such as metal can be used in, e.g., a film form.

The pressure roller 10*b* may, e.g., be prepared in an outer diameter of 30 mm by disposing a 5 mm-thick Si rubber layer on an outer peripheral surface of an iron core metal (outer diameter: 20 mm) and disposing a 10–50 μm-thick layer of PTFE or PFA in order to improve surface releasability similarly as in the fixation roller 10*a*.

The fixation roller 10*a* and the pressure roller 10*b* are rotatably supported, and only the fixation roller 10*a* is rotationally driven in a clockwise direction indicated by an arrow. The pressure roller 10*b* is pressed against the fixation roller 10*a* and disposed so as to be driven by frictional force at an abutment nip portion (fixation nip portion) N. Further, the pressure roller 10*b* is pressed toward a direction of rotation axis of the fixation roller 10*a* by an unshown mechanism using, e.g., a spring. The pressure roller 10*b* may be disposed under a load of, e.g., about 30 kg-wt. In this case, a resultant nip width at the abutment nip portion N is about 6 mm. However, the load applied to the pressure roller 10*b* may be changed, as desired, to change the nip width.

At the surface of the fixation roller 10*a*, a temperature sensor (temperature detection means) 33 is disposed so as to contact the fixation roller 10*a*. On the basis of a detection signal by the temperature sensor 33, an amount of supply of electric power to the exciting coil 38 is increased or decreased by a temperature control circuit (temperature control means) and a high-frequency converter 41, whereby the surface temperature of the fixation roller 10*a* can be automatically controlled so as to be constant.

A conveyance guide 34 is disposed in such a position that the recording material (transfer material) P to be carried while bearing thereon an unfixed toner image t is guided into the nip portion N created between the fixation roller 10*a* and the pressure roller 10*b*.

A separation claw 37 is disposed to abut against the fixation roller 10*a* surface and is to prevent paper jam by forcedly separating the recording material P in the case where the recording material P is affixed to the fixation roller 10*a* surface after passing through the nip portion N.

The winding of the exciting coil 38 of the magnetic flux generation means 36 has such a structure that lead wires are wound about a central projection portion of an elongated magnetic core 39 having an E-shaped cross section. Further, the exciting coil 38 is connected to the high-frequency converter 41, thus being supplied with a high-frequency power of 100–2000 W. For this reason, the lead wires comprises Litz wire consisting of strands of several thin wires and are coated with a heat-resistant layer in view of heat conduction thereto.

As the magnetic core 39, a material having a high permeability and a low loss. In the case of an alloy such as permalloy, it may be formed in a lamination structure since an eddy-current loss within the core becomes larger at a higher frequency. The core is used for the purposes of increase in efficiency of a magnetic circuit and of magnetic shielding.

The magnetic circuit portion comprising the coil and the core may be formed in an air-cored shape (i.e., no core structure) in the case where the magnetic shielding can be sufficiently ensured.

To the exciting oil 38, an AC current of 10–100 kHz is applied by the high-frequency converter 41. The magnetic flux induced by the AC current passes through the inside of the E-shaped magnetic core without leaking out, and first leaks out the outside of the magnetic member between the projection portions. As a result, an eddy current passes through the electroconductive layer (dielectric heating member) of the fixation roller 10*a*, whereby the electroconductive layer per se generated Joule heat. More specifically, the fixation roller 10*a* is subjected to electromagnetic induction heating, and supplied electric power to the exciting coil 38 is controlled, depending on an output of the temperature sensor 33, by the temperature control circuit 40 and the high-frequency converter 41. As a result, the temperature of the fixation roller 10*a* is temperature-controlled to a predetermined temperature. More specifically, in the case where the temperature control circuit judges that a difference between the output value of the temperature sensor 33 and a predetermined fixation temperature is small, the high-frequency converter 41 applies a high-frequency AC current to the exciting coil 38. On the other hand, in the case where the temperature control circuit judges that the output value of the temperature sensor 33 is higher than the predetermined fixation temperature, the high-frequency converter 41 stops the application of AC current to the exciting coil 38. Herein, the temperature control method is not limited to the above-mentioned method but may be performed by, e.g., ON/OFF control of energization while fixing electric power (frequency) to effect temperature control to a predetermined temperature.

(3) Image Density Detection Means and Fixation Device Heat Generating Rate Adjustable Means A detection means of image density information and a fixation device heat generating rate adjustable means will be described with reference to FIGS. 3 and 4.

Figure 3:
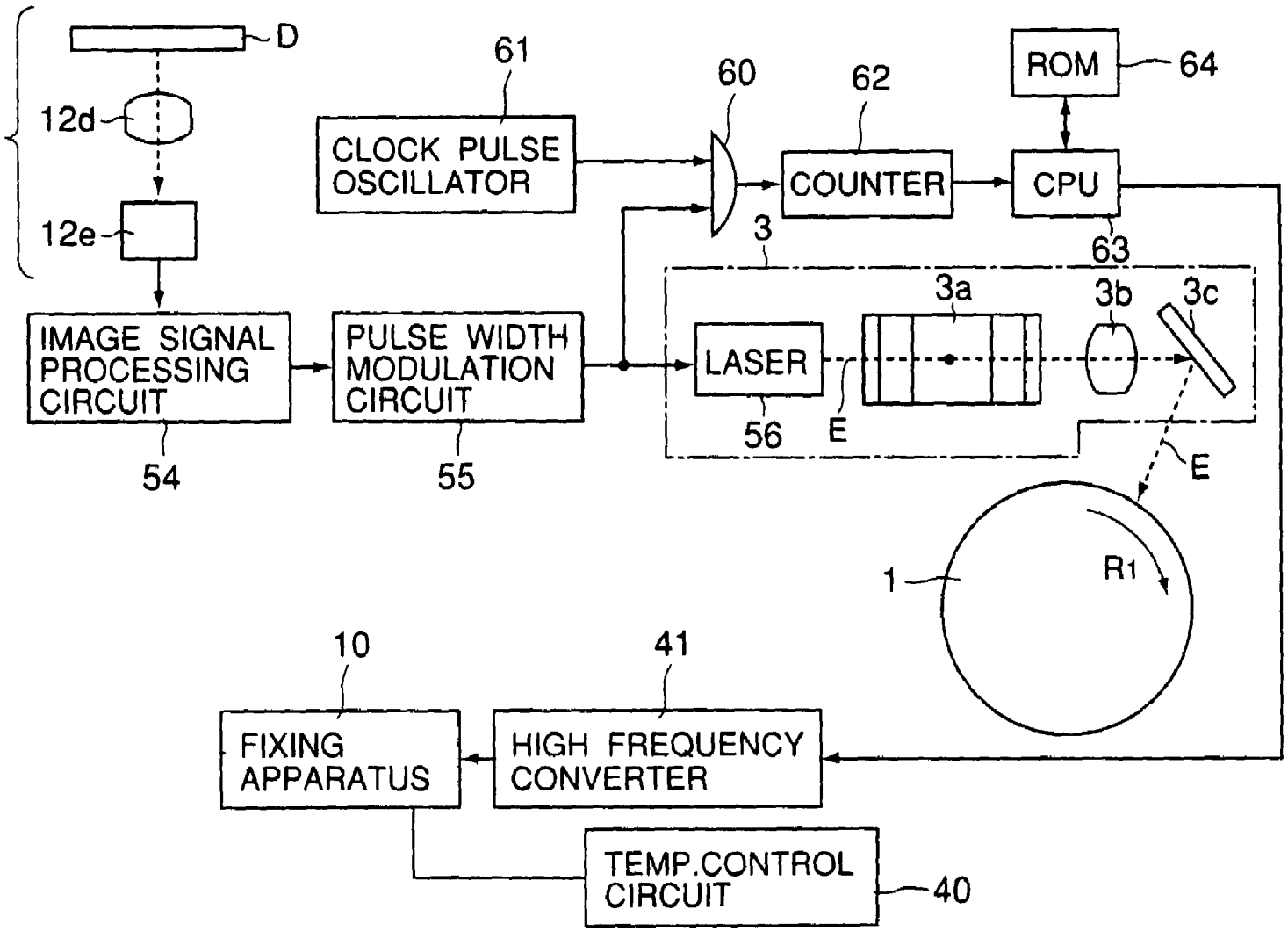
FIG. 3 is a black diagram of a control system.

Referring to FIG. 3, an image of the original D to be copied is projected on the image pickup device (full-color sensor) 12*e*, such as a CCD as density detection means, by the lens 12*d* of the above-described reader section II. This image pickup device 12*e* separates the original image into a multitude of pixels and generates photoelectric conversion signals corresponding to the respective pixels.

An analog image signal outputted from the image pickup device 12*e* is sent to an image signal processing circuit 54 wherein the analog image signal is converted into a pixel image signal having an output level corresponding to a density of an associated pixel for each pixel, and then is sent to a pulse width modulation circuit 55.

The pulse width modulation circuit 55 forms and outputs a laser-driven pulse having a width (time-length) corresponding to an associated level for each pixel image signal inputted into the circuit. More specifically, as shown in FIG. 4(*a*), a wider drive pulse W is formed for a high-density pixel image signal, a narrower drive pulse S is formed for a low-density pixel image signal, and an intermediary width-drive pulse I is formed for an intermediary-density pixel image signal.

The laser-driven pulse outputted from the pulse width modulation circuit 55 causes a semiconductor laser 56 of a laser output unit in the exposure means 3 of the above-mentioned printer section I to emit light from a period of time corresponding to its pulse width. Accordingly, the semiconductor laser 56 is driven for a longer time with respect to the high density pixel and is driven for a shorter time with respect to the low density pixel. As a result, the photosensitive drum 1 is exposed to light by an optical system of the exposure means 3 so that a wider range thereof in a main scanning direction is exposed to light with respect to the high density pixel and a narrower range thereof in the main scanning direction is exposed to light with respect to the low density pixel. In other words, a dot size of a resultant electrostatic latent image varies depending on the density of the associated pixel. In this regard, electrostatic latent images of low, intermediary and high density pixels are indicated by L, M and H, respectively, in FIG. 4(*d*).

The laser light E emitted from the semiconductor laser 56 is swept by the polygon mirror (rotating polygon mirror) 3*a* and is formed as a spot image on the photosensitive drum 1 by the lens, such as f/θ lens, and the fixed mirror 3*c* for directing the laser light E toward the direction of the photosensitive drum 1 being the image bearing member. As described above, the photosensitive drum 1 is scanned by exposure to light with the laser light E in a direction (main scanning direction) substantially parallel to the rotation axis of the photosensitive drum 1 to form an electrostatic latent image.

By the formation of the electrostatic latent image, a level of an output signal of the above-mentioned image signal processing circuit 54 is counted for each color. The counting is performed as follows in this embodiment shown in FIG. 3.

First, the output signal from the pulse width modulation circuit 55 described above is supplied to one of inputs of an AND gate 60. The other input of the AND gate 60 is supplied with a clock pulse (shown in FIG. 4(*b*)) from a clock pulse oscillator.

Figure 4:
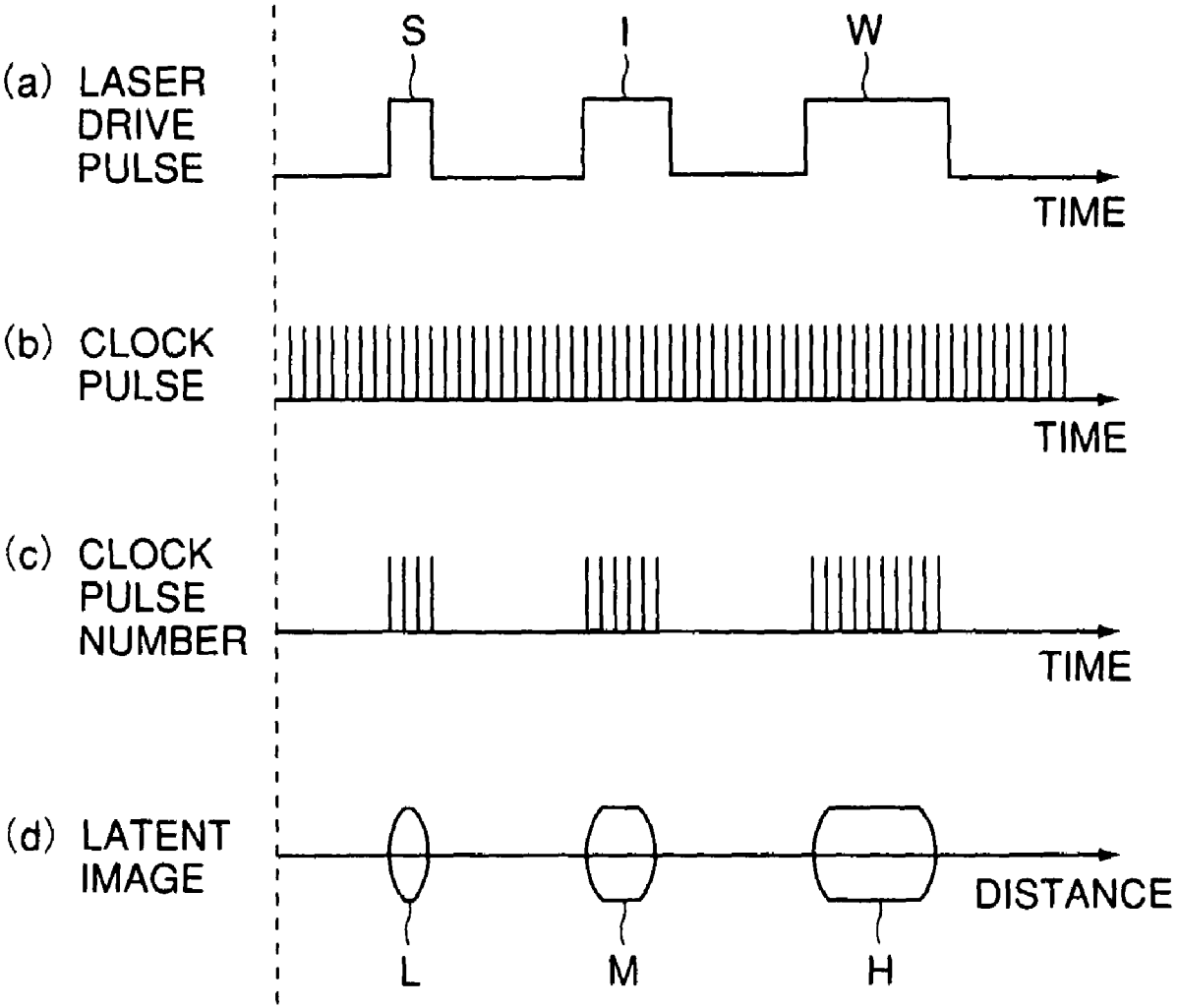
FIG. 4 is a waveform diagram for illustrating a method of counting density information of an image information signal.

As a result, as shown in FIG. 4(*c*), from the AND ate 60, such a clock pulse including portions pulse numbers of which correspond to the respective pulse widths of the laser-driven pulses S, I and W, respectively, i.e., a clock pulse including portions corresponding to image densities of the respective pixels, is outputted.

Summation of the number of the clock pulse is achieved by a counter 62 for each pixel to calculate a corresponding video count number. The video count number for each pixel is supplied to a CPU 63 of heat generating rate change means including the CPU 63 and ROM 64.

In the ROM 64, heat generating rates of the fixation device 10 depending on video count numbers of the respective pixels are stored.

The CPU 63 calculates a proportion of image density per one original with respect to the BK toner, the Y toner, the M toner and the C toner, on the basis of the video count numbers of the respective pixels, and determines an optimum heat generating rate of the fixation device 10 (i.e., the sum of heat generating rates, of the fixation device 10, depending on the video count numbers), thus outputting optimum heat generating rate information to a high-frequency inverter 41 of the fixation device 10. The high-frequency inverter 41 effects control of AC current to be applied to the fixation device 10.

In this embodiment, the optimum heat generating rate is determined by calculating an average image density per one original but may also be determined by such a method wherein a heat generating rate at a portion of high image density is changed in the case where there is a difference in image density within one original. Further, it is also possible to make judgment as to whether the density information is for mono-color or full-color and increase a heat generation rate in the case of the full-color density information.

In this embodiment, the image density is obtained from the video count number by the counter 62 but may also be obtained by directly detecting the image density of the unfixed toner image on the photosensitive drum 1 or the recording material P by a density detection member.

Figure 6:
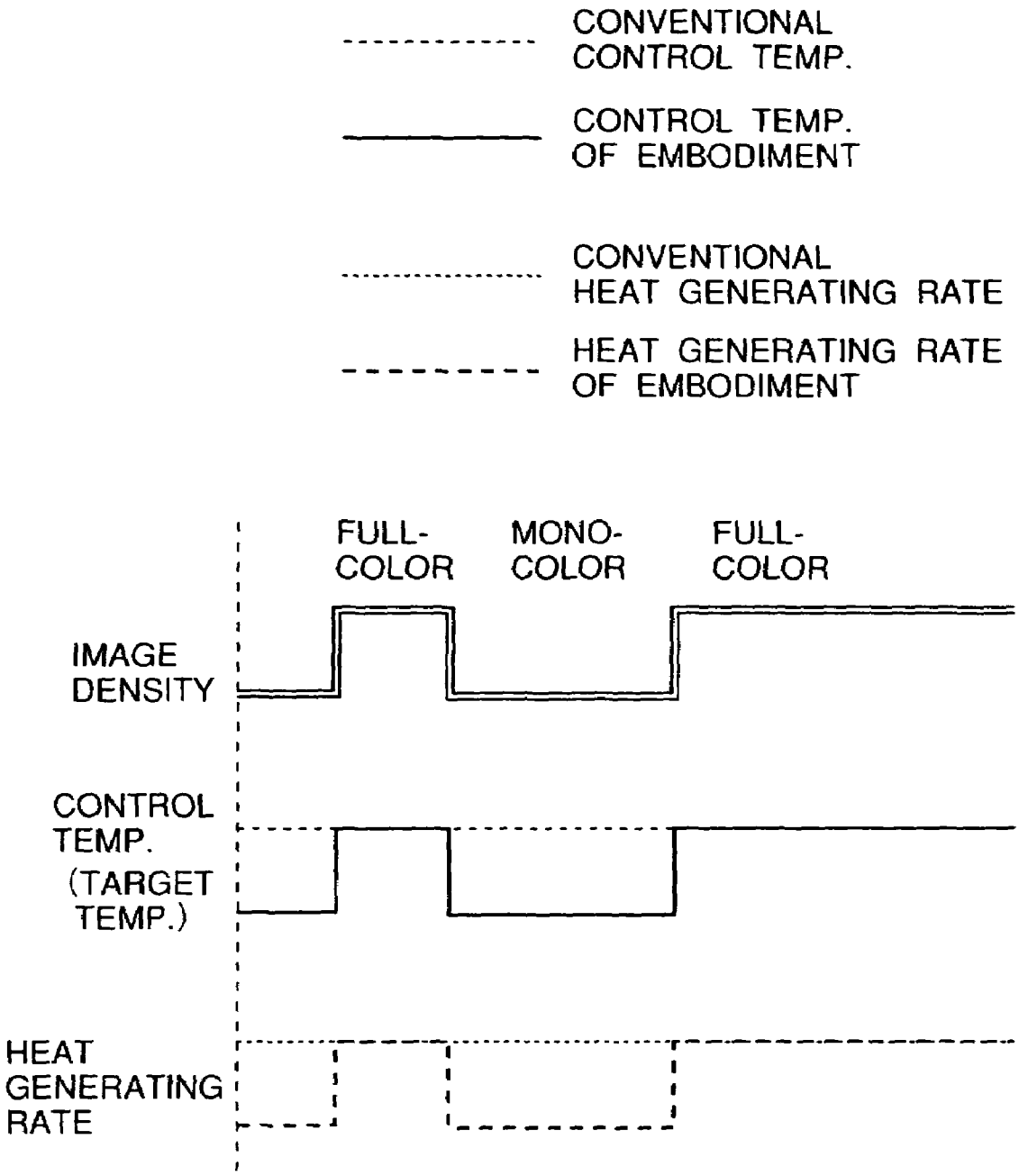
FIG. 6 is a view showing progression of heat generating rate in the case of mono-color image formation and full-color image formation with a control temperature is changed in an embodiment of the present invention.

A progression of the heat generating rate in this embodiment is shown in FIG. 6.

Figure 7:
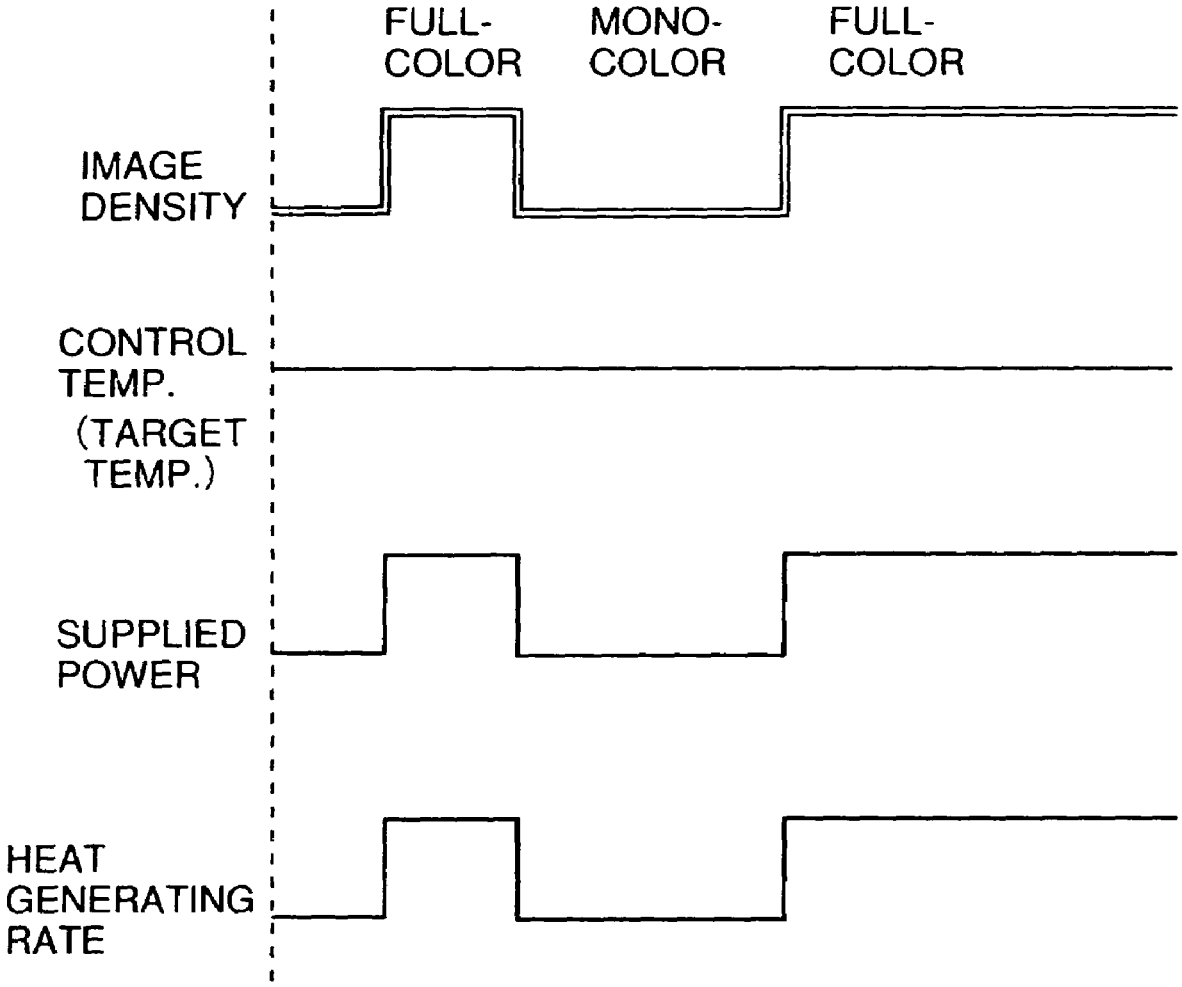
FIG. 7 is a view showing progression of heat generating rate in the cases of mono-color image formation and full-color image formation when a control temperature is constant.

Referring to FIG. 6, when the image density per one original is judged to be approximately at a full-color level, the heat generating rate of the fixation device 10 is controlled to be higher than that at the time of fixation of the mono-color original. In other words, in this embodiment, the quantity (amount) of power consumption (heat generating rate) is increased only in the case of high image density, so that it becomes possible to reduce power consumption when compared with the conventional fixing apparatus. More specifically, the heat generating rate of the fixation device 10 is changed by changing a control temperature (target temperature) of the fixation device 10 as shown in FIG. 6. As another method of changing the heat generation rate, as shown in FIG. 7, a frequency (electric power) of the high-frequency current applied to the exciting coil 38 is changed without changing the control temperature (target temperature), thus changing the heat generating rate. Generally, the heat generating rate has a frequency dependency, so that the heat generating rate can be changed by changing the frequency. As described above, the heat generating rate is changed with no change in control temperature (target temperature) of the fixation device 10, so that a time lag at the time of changing the control temperature is not caused to occur, and the control temperature is not changed (increased). As a result, it is possible to reduce the possibility of short-circuit of the coil due to a temperature in excess of the heat-resistant temperature of the coil and the possibility of change in gloss of the image depending on the control temperature. Further, even in the case where the image density is high and the amount of heat adsorbed by the toner is large, the amount of power consumption is correspondingly increased in the present invention. As a result, the temperature of the fixing rate can be returned immediately to the target temperature to enhance responsibility.

The control of the heat generating rate of the fixation device 10 (fixing rate 10*a*) can also be achieved by changing a current or a voltage to be applied to the exciting coil 38 as well as the frequency of high-frequency current to be applied to the exciting coil 38.

The fixation device 10 used in this embodiment include the exciting coil 38 for heating the fixing rate 10*a* by electromagnetic induction heating, and the magnetic core 39 within the fixing roller 10*a*, but these members 38 and 39 of the magnetic flux generation means 36 may be disposed outside the fixing rate 10*a* so as to directly heat the fixing rate surface in combination with the control of heat generating rate in this embodiment described above. By doing so, it becomes possible to reduce power consumption of the fixation device 10.

Figure 5:
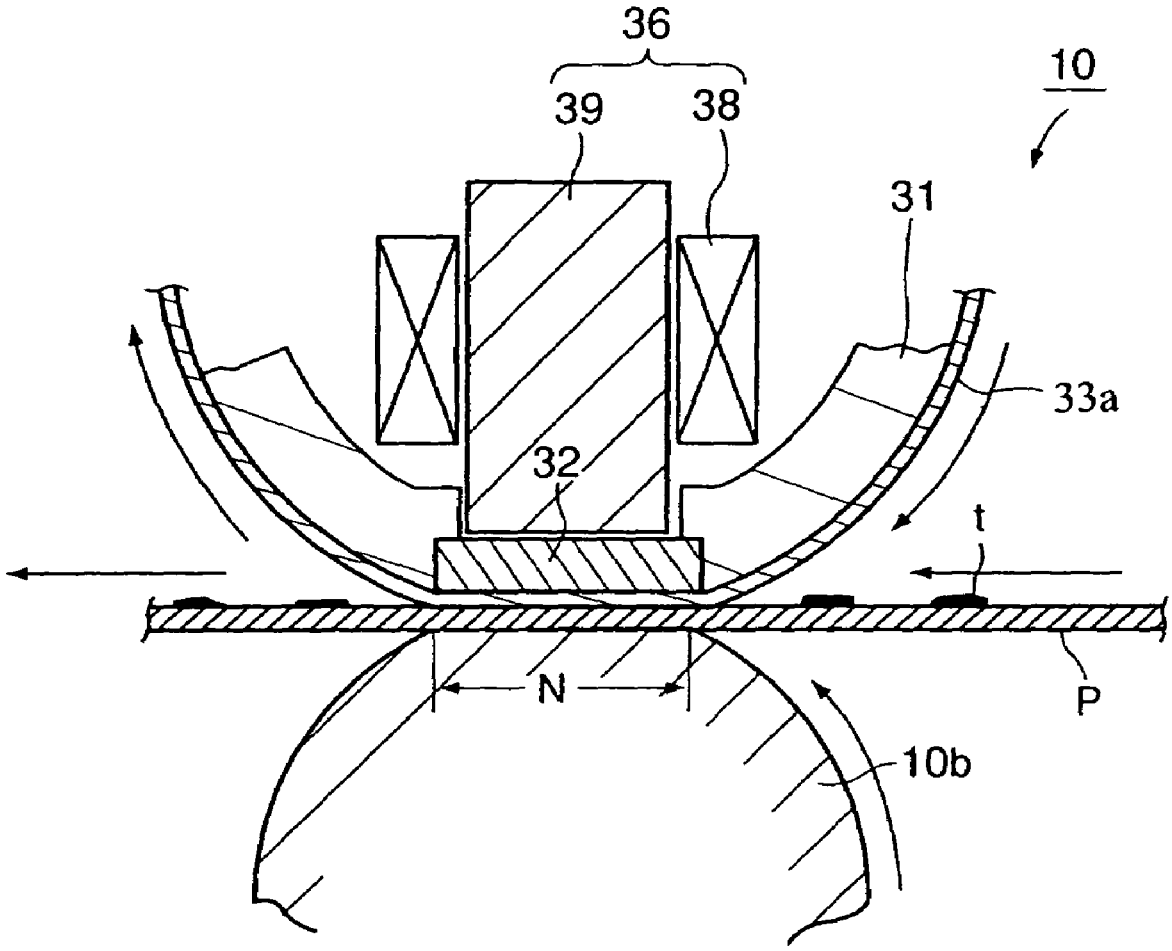
FIG. 5 is a schematic cross-sectional view of a principal portion of another embodiment of a fixation device.

FIG. 5 is a schematic sectional view of a principal part of another embodiment of the fixation device 10 of the electromagnetic induction heating type.

Referring to FIG. 5, the fixation device includes a holding member 31, an induction heating member 32, such as iron plate, downwardly fixed and held by the holding member 31, a heat-resistant fixation film 33 which is slidably movable to the lower surface of the fixed induction heating member 32, and an elastic pressure roller 10*b*. The elastic pressure roller 10*b* is pressed against the lower surface of the induction heating member 32 through the fixation film 33 to form a nip portion N. The induction heating member 32 generates heat by electromagnetic induction heating by the action of magnetic flux created by magnetic flux generation means 36 comprising an exciting coil 38 and a magnetic core 39.

A recording material P carrying thereon an unfixed toner image t is guided to the nip portion N between the fixation film 33 and the pressure roller 10*b* and conveyed in the nip portion N while being sandwiched therebetween, whereby the toner image t absorbs heat from the induction heating member 32 through the fixation film 33, thus being heated and pressed to be fixed on the surface of the recording material P. The recording material P after being passed through the nip portion N is successively separated from the surface of the fixation film 33 and then is conveyed for discharge.

As described above, the present invention is applicable to the case of the apparatus using a fixed-type induction heating member.

The image forming principle and process of the unfixed toner image t onto the recording material P is not particularly limited but may be performed in an arbitrary manner.

In the above-described embodiment, the fixing apparatus of the induction heating type is described. The fixing apparatus of the present invention is, however, limited thereto.

Figure 8:
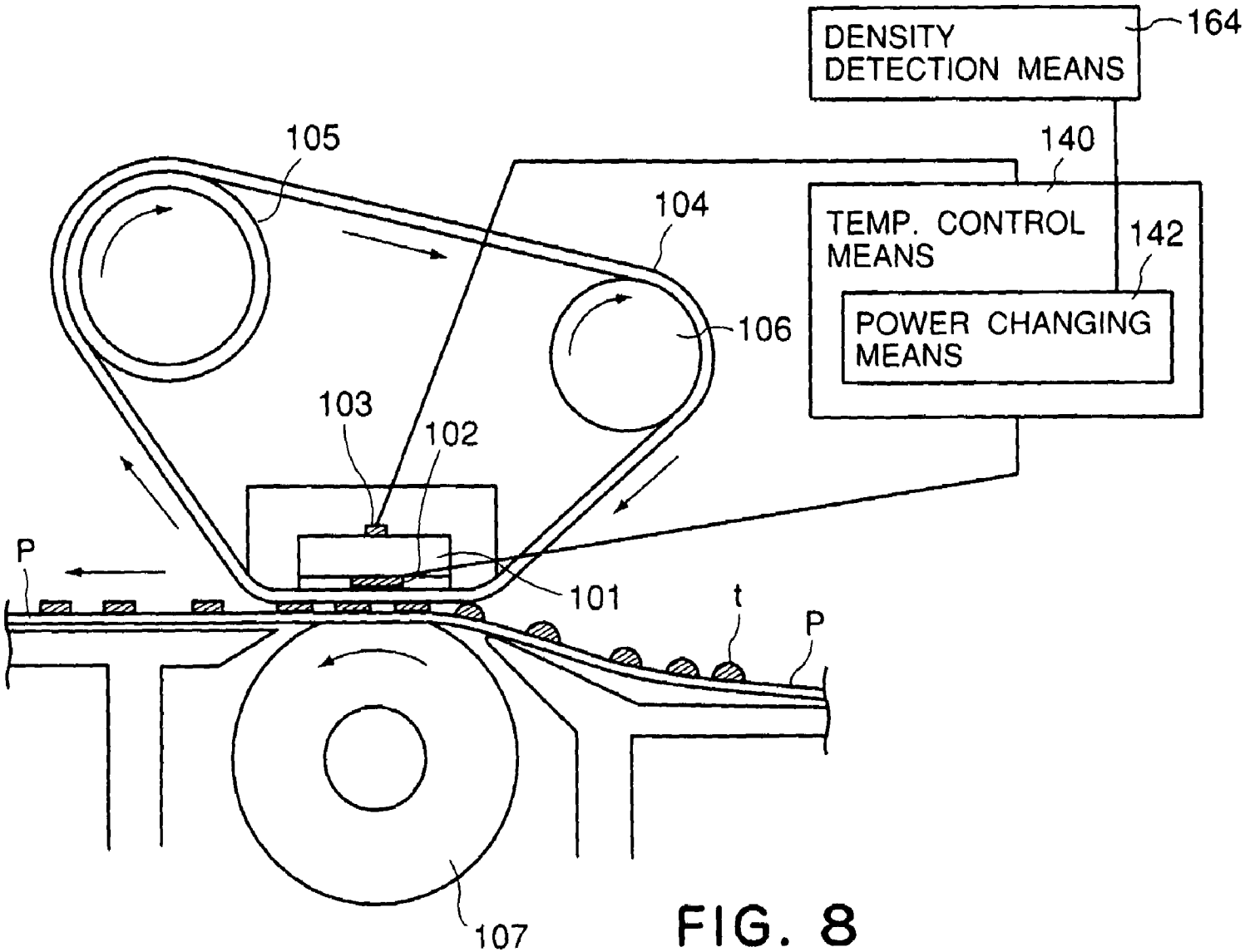
FIG. 8 is a schematic view of an embodiment of a film heating-type fixation device.

As another embodiment of the fixing apparatus of the present invention, a film heating-type (surf-type) fixing apparatus or fixing an unfixed image on a recording material by heating the image via a heat resistant film with, e.g., a ceramic heater is shown in FIG. 8.

Referring to FIG. 8, the fixing apparatus includes a low-heat capacity heater (heating members) which is fixed to the fixing apparatus and includes a high-heat conductivity substrate 101 of, e.g., alumina (thickness: 1.0 mm; width: 10 mm; and longitudinal length: 340 mm) and a resistive material (heating member) 102 coated on the substrate 101 with a width of 1.0 mm. The heater is energized from both ends thereof in its longitudinal direction.

The energization is performed by, e.g., a pulse-shaped waveform voltage (voltage: 100 V; and repetitive interval: 20 msec).

Referring again to FIG. 8, a temperature of a heating member (means) 102 is detected by a thermistor (temperature detection means) 103, and an amount of energization to the heating member 102 is controlled by a temperature control means 140 so that the heating member 102 has a predetermined temperature. A pulse width becomes approximately 0.5–5 msec. At this time, on the basis of density information from a density detection means 164, an electric power supplied to the heating member 102 is changed by an electric power change means 142. More specifically, in the fixing apparatus of the surf-type or a halogen lamp-type, a heat generating rate for heating the heating member 102 is changed depending on the image density by the electric power change means 142, whereby it is possible to impart an optimum amount of heat on the basis of the image density to an unfixed image t on a recording material P.

A fixation film 104 is moved in a direction indicated by arrows while abutting the heater (101, 102) which is controlled in terms of temperature and energy. The fixation film 104 may, e.g., by an endless film comprising a 20 μm-thick heat resistant film of polyimide, polyester ether imide, PES (polyether sulfide) or PFA, and a 10 μm-thick release layer which is coated on the heat resistant film at least on an image abutment side and prepared by adding an electroconductive agent in a fluorine-containing resin such as PTFE or PFA. The total thickness of the fixation film 104 is generally not more than 100 μm, preferably not more than 70 μm. The fixation film 104 is driven under tension by a drive roller 105 and a follower roller 106 (driven by the drive roller 105) in a direction of the arrows without causing crinkles. A pressure roller (pressing member) 107 having an elastic rubber layer of, e.g., silicone rubber, possessing a good releasability, presses the heater (101, 102) via the fixation film 104 at a total pressure of 4–15 kg and rotates while abutting the fixation film 104.

In this embodiment, depending on the image density, either one or both of a current and a voltage instead of the electric power.

Further, when the fixation is performed without changing the control temperature of the fixing rate in this embodiment, there is no time lag at the time of changing the control temperature and it is possible to reduce the possibility of a change in gloss of a resultant image depending on the control temperature.

In this embodiment, as information on the density of the image formed on the recording material P, a signal obtained by the image pickup device 12*e* is used but information obtained by the density sensor S2 may also be used.

As described hereinabove, according to the image forming apparatus of the present invention, it is possible to reduce electric power consumption of the fixation means by detecting a density of a formed image in the image forming means and then setting a heat generating rate (or heating rate) of the fixation means to an appropriate value on the basis of the detected image density.

What is claimed is:

1. An image forming apparatus, comprising:

image forming means capable of executing each of a single color mode in which an image is formed of toner of a single color on a recording material and a plural color mode in which the image is formed of toners of a plurality of colors on a recording material;

a coil for generating a magnetic flux by energization;

a fixing member for fixing an image on a recording material by generating heat by the magnetic flux; and power control means, capable of setting a target temperature of said fixing member for fixing the image on the recording material at the time of selecting the single color mode to be identical to that at the time of selecting the plural color mode, for changing a value of electric power to be supplied to said coil so that a temperature of said fixing member is a target temperature in a case the target temperature at the time of selecting the single color mode is set to be identical to that at the time of selecting the plural color mode.

2. An apparatus according to claim 1, wherein the value of electric power to be supplied to said coil in the single color mode is smaller than that in the plural color mode.

3. An apparatus according to claim 1, wherein the value of electric power to be supplied to said coil is changed by changing a frequency of a high-frequency current to be applied to said coil.

4. An image forming apparatus, comprising:

image forming means capable of executing each of a single color mode in which an image is formed of toner of a single color on a recording material and a plural color mode in which the image is formed of toners of a plurality of colors on the recording material;

a heater for generating heat;

a fixing member for fixing the image on the recording material by the heat generated by said heater; and power control means, capable of setting a target temperature of said heater for fixing the image on the recording material at the time of selecting the single color mode to be identical, to that at the time of selecting the plural color mode, for changing a value of electric power to be supplied to said heater so that a temperature of said heater is a target temperature in a case the target temperature at the time of selecting the single color mode is set to be identical to that at the time of selecting the plural color mode.

5. An apparatus according to claim 4, wherein the value of electric power to be supplied to said heater in the single color mode is smaller than that in the plural color mode.

* * * * *

UNITED STATES PATENT AND TRADEMARK OFFICE

CERTIFICATE OF CORRECTION

PATENT NO. : 7,196,296 B2
APPLICATION NO. : 11/183886
DATED : March 27, 2007
INVENTOR(S) : Naoyuki Yamamoto It is certified that error appears in the above-identified patent and that said Letters Patent is hereby corrected as shown below:

COLUMN 1
Line 29, “an” should read --a--.
Line 37, “o” should read --of--.
Line 48, “electro-conductive” should read --electroconductive--.

COLUMN 2
Line 8, “However” should read --However,--.
Line 17, “an” should read --a--.

COLUMN 4
Line 4, “aid” should read --said--.
Line 29, “aid” should read --said--.
Line 52, “with” should read --when--.

COLUMN 5
Line 13, “o” should read --of--.

COLUMN 6
Line 39, “material 8” should read --material P--.
Line 66, “density sensor 82” should read --density sensor S2--.

COLUMN 7
Line 5, “While” should read --while--.

COLUMN 8
Line 5, “a” should be deleted.
Line 7, “o” should read --of--.
Line 11, “is beard” should read --bears--.
Line 67, “permeability p” should read --permeability $\mu$--.

COLUMN 9
Line 49, “comprises” should read --comprise--.
Lines 51, “material having” should read --material is used having--.

COLUMN 10
Line 57, “from” should read --for--.

UNITED STATES PATENT AND TRADEMARK OFFICE

CERTIFICATE OF CORRECTION

PATENT NO. : 7,196,296 B2
APPLICATION NO. : 11/183886
DATED : March 27, 2007
INVENTOR(S) : Naoyuki Yamamoto It is certified that error appears in the above-identified patent and that said Letters Patent is hereby corrected as shown below:

COLUMN 11
Line 26, "AND ate 60," should read --AND gate 60,--.

COLUMN 12
Line 38, "include" should read --includes--.

COLUMN 13
Line 14, "limited" should read --not limited--.
Line 48, "by" should read --be--.

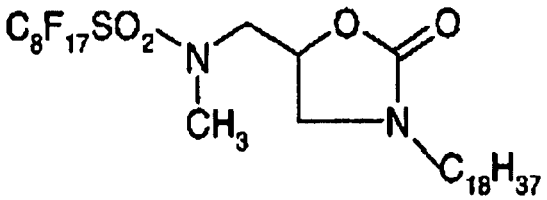

Signed and Sealed this

Eighteenth Day of March, 2008

JON W. DUDAS
*Director of the United States Patent and Trademark Office*